United States Patent [19]

Chan

[11] Patent Number: 4,628,810

[45] Date of Patent: Dec. 16, 1986

[54] PRINTING MACHINE

[75] Inventor: Wilson Chan, Hong Kong, Hong Kong

[73] Assignee: Space Lab (Hong Kong) Enterprises Ltd., Hong Kong

[21] Appl. No.: 584,210

[22] Filed: Feb. 27, 1984

[51] Int. Cl.[4] ..... B31F 1/07

[52] U.S. Cl. ..... 101/27; 101/407 BP

[58] Field of Search ..... 101/27, 3, 4, 316, 30–32, 101/25–26, 407 BP

[56] References Cited

U.S. PATENT DOCUMENTS

| | | | |
|---|---|---|---|
| 924,990 | 6/1909 | Holland | 101/316 |
| 1,258,944 | 3/1918 | Putnam | 101/27 |
| 1,261,690 | 4/1918 | Brooke | 101/27 |
| 1,438,191 | 12/1922 | Smith et al. | 101/27 |
| 2,011,949 | 8/1935 | Roberts, Jr. | 101/27 |
| 3,990,360 | 11/1976 | Nethercot | 101/27 |
| 4,023,482 | 5/1977 | Swett et al. | 101/27 X |

*Primary Examiner*—Edgar S. Burr
*Assistant Examiner*—Moshe I. Cohen
*Attorney, Agent, or Firm*—Townsend and Townsend

[57] ABSTRACT

The present hot printing machine aims to be easier to use and comprises a printing platten for carrying the item to be printed which is reciprocatable between a forward loading and unloading position and a rearward printing position, a downwardly movable printing head including means for heating a printing die, means for linking the downward movement of the printing head with the rearward movement of the reciprocatable platten so that, before contact of the die with the item to be printed, the reciprocatable platten has been moved to its rearward printing position and means for supporting a length of printing foil beneath the heated die so that when the die is pressed against the item to be printed, the foil is sandwiched therebetween to give the printing effect required. Preferably, the heated platten carrying the printing die is pivotally mounted so that it can be turned outwardly to expose the underside of the heated platten for the ready attachment of the printing die. In this preferred embodiment, this pivoting arrangement very much increases the ease with which the operator can change the printing die.

11 Claims, 3 Drawing Figures

PRINTING MACHINE

This invention relates to printing machines and in particular hot printing machines, that is to say, those which print by transfer from a metallised foil onto a substrate by means of a heated die which contacts the foil. Such hot printers are sometimes known as hot stamping machines.

BACKGROUND TO THE INVENTION

Hot printing machines can be used in the printing of a wide range of substrates including paper, card and synthetic plastics material. The foil can be obtained in a wide range of colours so that the printing applied to the substrate can be in almost any desired colour.

Hot printing machines have tended either to be large, complex machines which are operated automatically or to be small, hand-operated machines whose convenience is somewhat limited. In particular, the small hand-operated machines generally have a rather limited size for the printing die and access to insert an item for printing or to remove a printed item has been rather restricted. As a result, the operation of such machines has been slow and, because of the restricted access, there is always the danger of the operator's fingers touching the hot printing die.

The invention has therefore been made with these points in mind and aims to provide a hot printing machine in which it is easier to insert and remove the items being printed.

BRIEF SUMMARY OF THE INVENTION

According to the invention, there is provided a hot printing machine comprising a printing platten for carrying the item to be printed which is reciprocatable between a forward loading and unloading position and a rearward printing position, a downwardly movable printing head including means for heating a printing die, means for linking the downward movement of the printing head with the rearward movement of the reciprocatable platten so that, before contact of the die with the item to be printed, the reciprocatable platten has been moved to its rearward printing position and means for supporting a length of printing foil beneath the heated die so that when the die is pressed against the item to be printed, the foil is sandwiched therebetween to give the printing effect required.

In such a machine, access for loading a fresh item to be printed or unloading a printed item is not a problem since the reciprocatable platten is moved to a forward, exposed position after the printing step. Therefore, the operator does not have the problem of putting his fingers into an area close to the hot die. As a result, the operator can more quickly and surely place an item to be printed and so losses as a result of poor alignment of the printing can be reduced.

Because the reciprocatable printing platten is moved clear of the heated die, once the printing step is complete, more room is left in the region of the printing die and as and when required, it is therefore easier to replace and change the printing die, type or block, referred to herein for convenience as printing die. In a preferred embodiment of the invention, the heated platten carrying the printing die is pivotally mounted so that it can be turned outwardly to expose the underside of the heated platten for the ready attachment of the printing die. In this preferred embodiment, this pivoting arrangement very much increases the ease with which the operator can change the printing die.

The hot printing machine is preferably provided with a pivoted handle which moves both the heated platten and the printing head simultaneously to bring them into position for a printing step. This manually operated handle is preferably joined by a number of cranks and pivoted levers to cause the reciprocation of the printing platten and the printing head, the cranks and lever desirably being arranged so that as the limit of movement towards the printing position is reached, the mechanical advantage of the system increases. In this way, the pressure applied for printing can be large and the movement of the printing platten as it approaches its rearward position can be slight. Desirably, the printing platten reaches the limit of its rearward movement slightly in advance of the instant the printing die of the printing head contacts the item to be printed.

In order to provide room for the reciprocatable lower platten to move between its forward and rearward positions, the heated printing head and the pivotable handle are preferably carried by an upwardly and forwardly curved arm whose lower end is fixed to the rear of a base plate for the hot printing machine.

BRIEF DESCRIPTION OF THE DRAWINGS

A hot printing machine according to the invention will now be described, by way of example, with reference to the accompanying drawings, in which.

DESCRIPTION OF THE PREFERRED EMBODIMENT

Figure 1:
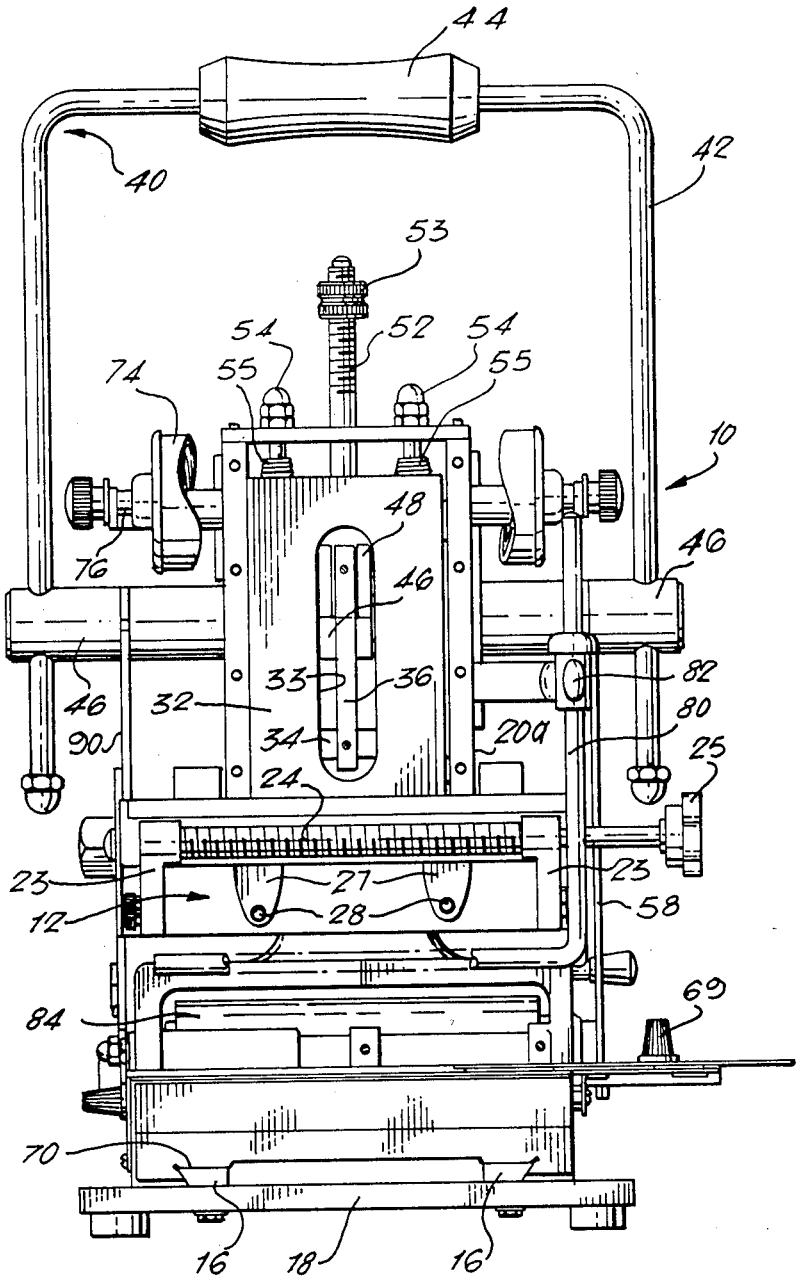
FIG. 1 is a front view of the hot printing machine.

The hot printing machine 10 shown in the drawings comprises a printing head 12 and a printing platten 14. The latter is reciprocably mounted on rails 16 fixed to a baseboard 18. At its rear, the board supports an upwardly and forwardly curved arm 20 which in turn carries the printing head 12 at its upper and forward end.

The printing head 12 contains electric heating elements, not shown, which provide heat to a metal block or plate 22. Hanging down from the latter are a pair of downwardly directed side flanges 23 which are supported on a threaded rod 24. They are movable in and out by rotation of the rod 24 by means of a knob 25 and are provided with a large number of Allen key-operated threaded screws 26 and front and rear trunnions 27 having similar screws 28. These various screws and the clamping action of the flanges 23 are used to grip a metal printing die, not shown, which can be in the form of a metal block, metal type or the like. By simple adjustment of the flanges 23 and screws 26 and 28, the printing die can be accurately and firmly located so that it is in good heat contact with the plate 22 and therefore becomes heated by the electric heaters.

To assist in setting the printing die, the plate 22 is pivotable about a pin 29 upon release of spring clips 31. In this way, the plate 22 can pivot forwardly and downwardly to expose its underside from the front of the machine and so facilitate setting up of the printing die. The plate 22 can be held in this orientation temporarily by engagement of a pin **22*a*** on the side of the plate with a prop 22*b* which can be hinged up from the side of the printing platten 14.

The arm 20 has, at its upward and forward end, an upright crosspiece 20*a* within which is slidably mounted a support plate 32. The lower end of this plate is attached to the heated plate 22 and so supports the printing head 12. The support plate 32 has at its centre a hollow slot 33 across the lower end of which is a pivot pin 34 received in the plate 32. Attached to that pivot pin 34 is a link 36 which, as will be described below, moves the plate 30 and so the printing head 12.

Figure 3:
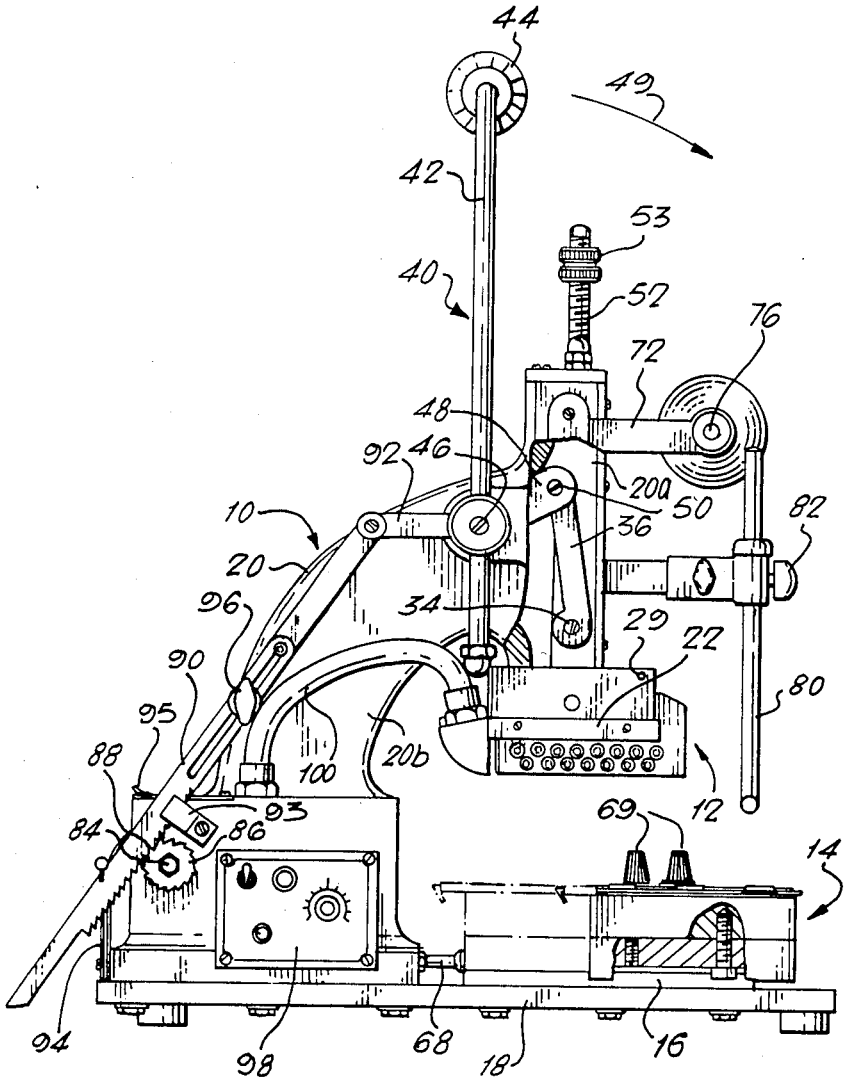
FIG. 3 is a view of the machine taken from the other side, again with some parts broken away.

An operating handle 40 is pivotally carried near the top of the curved part 20*b* of the arm 20. This operating handle comprises a U-shaped bar 42 having a central grip 44. Both ends of the bar are fixed to a spindle 46 which is in turn journalled near the upper end of the portion 20*b*. The arm 20 is hollow and, as best shown in FIG. 3, a crank 48 is fixed to the spindle 46 within the arm. The crank is in turn pivoted at the point 50 to the link 36. In this way, when the handle 40 is pulled forwardly and downwardly about the spindle 46 in the direction of the arrow 49, the crank rotates about the spindle 46 and moves the printing head 12 downwardly by means of the link 36.

As the printing head 12 approaches its downward printing position, the crank 48 and link 36 progressively approach a straight line configuration and so the mechanical advantage of the linkage is increased so that the pressure applied on the printing head progressively increases whilst the degree of movement decreases. In this way, the operator can apply a high pressure at the moment of printing.

Extending upwardly from the plate 32 and out through the top of the upright crosspiece 20*a* is a threaded rod 52. On this rod is fixed a nut 53 which contacts the top of the crosspiece 20*a* and so limits the extent of downward movement of the printing head. This extent of movement can be adjusted by adjustment of the position of the nut 53 along the rod 52.

Fixed between studs 54 attached to the crosspiece 20*a* and the plate 32 are a pair of tension springs 55. As the plate 32 moves downwardly, these springs are extended. Therefore, at the completion of a printing step when the handle 40 is released, the springs return the head 12 and handle 40 to their starting positions as shown in the drawings.

Figure 2:
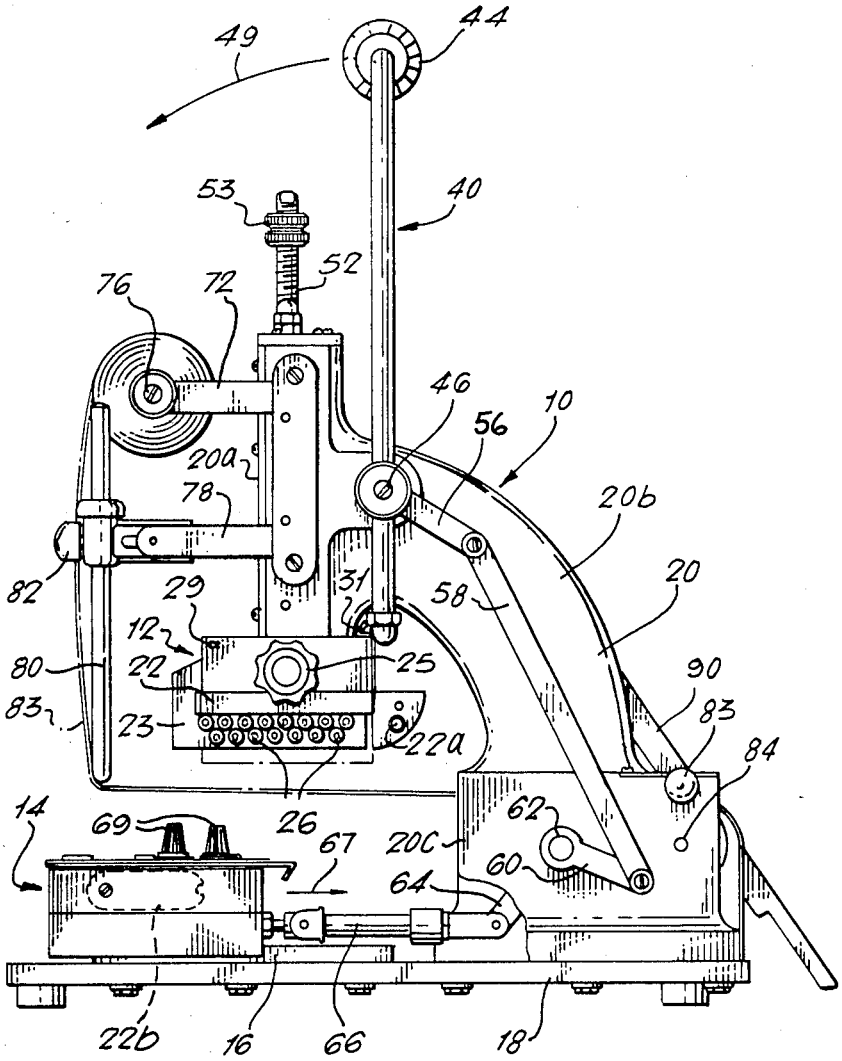
FIG. 2 is a view of the machine taken from the right-hand side with some parts partially broken away.

As best shown in FIG. 2, another crank 56 is attached to the spindle 46 and is joined by a lever 58 to a crank 60 journalled in the lower enlarged base 20*c* of the arm 20. The crank 60 is attached to a spindle 62 journalled in the base 20*c*, which in turn is hollow, and within that base a crank 64 is attached to the spindle 62. The crank is attached by means of a link 66 of adjustable length to the sliding printing platten 14. Actuation of the handle 40 in the manner described above in connection with the printing head will therefore, by means of the cranks 56, 60 and 64, lever 58 and link 66, cause the printing platten 14 to move in a rearward direction corresponding to the arrow 67 shown in FIG. 2. Thus, the printing platten 14 is moved to the rearward position (ghost lines FIG. 3) where it is directly beneath the head 12. The cranks 56 and 64 are angled such that the platten 14 reaches its rearward position before the handle 40 is fully pivoted and before the printing die carried by the head contacts the platten 14. This is achieved because towards the end of the limit of movement of the operating handle 40, the lever 58 and crank 60 and the crank 64 and link 66 are almost aligned and the platten contacts stops 68.

The printing platten 14 has an upper surface on which an item to be printed is located. To retain the item in place, a conventional easel arrangement, not shown in detail, is provided whose sliding arms are controlled by knobs 69. In this way, the arms of the easel trap and align the sheet of material to be printed which can be a sheet of paper, card, synthetic plastics material or the like and hold it in place during the printing step.

The underside of the printing platten 14 is provided with dove tail shaped recesses 70 which engage the correspondingly shaped rails so aligning the path of movement of the printing platten 14 and holding the platten onto the baseboard 18.

Projecting forward from the crosspiece 20*a* are the arms 72 of a bracket for supporting a roll of foil 74. The latter is carried on a spindle 76 held by the bracket. Mounted on another bracket 78 attached to the crosspiece 20*a* is a guide in the form of an L-shaped rod 80. This rod 80 is adjustably carried by the bracket 78 and its position and orientation are controlled by a screw 82. In the normal operating position, the guide is positioned as shown in FIG. 2 so that a length of foil 83 from the roll 74 passes downwardly from the roll 74 and beneath the guide 80 before passing underneath the printing head 12.

At the rear of the base 20*c* are journalled a pair of nip rolls 83 and 84 for drawing foil from the roll 74. The rolls 84 has fixed to it a gear 86 meshing with a rack 88 on a lever 90 of adjustable length. In turn, the lever 90 is pivoted to a crank 92 fixed to the spindle 46 and so moved by the handle 40. The teeth on the gear 86 and rack 88 are shaped so that in the upward movement of the lever, the teeth slide past one another without drawing the gear 86 but in the reverse downward movement, they engage and the gear and roll 84 are rotated. Thus, when the handle is moved to the printing position, the rack slides over and does not rotate. However, when the handle is released, the rack 88 drives the gear 86 and the roll 84 so drawing a fresh length of foil from the roll 74 underneath the printing head. A guide 93 attached to the side portion 20*c* keeps the rack 88 in contact with the gear 86 together with a spring 94 which resiliently urges the rack down against the gear 86. The roll 83 is additionally resiliently urged down against the roll 84 by a spring 95.

The lever 90 is in two parts which are adjustably held together by means of a screw 96 so that the point at which the rack first contacts the gear can be adjusted so adjusting the extent of rotation of the spindle 84 upon each operation of the handle 40 so that the correct amount of foil can be drawn from the roll 74 to ensure that there is a fresh portion of foil beneath the printing head for each printing operation.

The portion 20*a* houses the controls 98 for the electric heating of the printing head and a flexible electric connection 100 is provided between those controls and the printing head so that the precise printing temperature can be controlled thermostatically and also preselected to suit the particular printing operation in hand.

It is believed that with the above description, the operation of the hot printing machine 10 will be entirely clear.

As will be appreciated, the device is simple and easy to operate in addition because the printing platten 14 is moved to a forward position, i.e. towards the left as shown in FIG. 2. From its printing position beneath the printing head 12 there is plenty of room for an operator to gain ready access for the removal of a printed item and location of a new item for printing. Therefore, this removal and location can be a quick and accurate position. In addition, during this removal and location the operator's fingers are not too close to the hot printing die as they would be if the printing platten remained beneath the printing head at all times.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A hot printing machine comprising:

a printing platten for supporting an item to be printed, means for mounting said platten for reciprocal movement along a substantially horizontal first axis between a forward loading and unloading position and a rearward printing position, a printing head reciprocally movable along a substantially vertical second axis, and capable of carrying a printing die, heating means included in said head for heating a die carried by said head, a handle mounted on the machine for pivotal movement about an axis substantially perpendicular to the plane containing said first and second axes, link means for linking movement of said handle with movement of said printing head and with movement of said platten so that, before contact of said die with said item to be printed, said platten has been moved to its rearward printing position, means for supporting a supply roll of printing foil forwardly of said second axis, and means for guiding said foil along a path substantially in the plane containing the first and second axes which passes beneath said heated die to a take-up mechanism so that when said die is pressed by said head against said item to be printed, the foil is sandwiched therebetween to give the printing effect required, and a gear coupled to the take-up mechanism, and a rack urged against the gear, the rack and gear forming a ratchet by which the rack rotates the gear to draw a length of said foil along said path during movement thereof in one direction, and slides over the gear during movement thereof in the other direction, such reciprocal movement being coupled to the handle such that a length of foil is drawn along said path as the handle is pivoted in one direction, but not in the other.

2. A machine according to claim 1 wherein said printing head comprises a heated platten carrying said printing die and said heating means, and further comprising pivot means for pivotally mounting said heated platten relative said head whereby said heated platten can be turned outwardly to expose its underside for ready attachment or replacement of said printing die.

3. A machine according to claim 1 further comprising a stationary support base on which said printing platten is reciprocatably mounted, and an upwardly extending arm joined at one end to said base and at its other end supporting said downwardly movable printing head.

4. A machine according to claim 3 wherein said arm is of a curved shape and extends upwardly and forwardly from said base.

5. A machine according to claim 1 further comprising an axle about which said handle is pivotally mounted and in which said link means include a first crank fixed to said axle and a pivoted link positioned between said crank and said printing head for moving said head as said lever pivots, and a second crank fixed to said axle and at least one pivoted linkage pivoted to said second crank and also linked to said printing platten to move said platten as said handle is pivoted, the arrangements of said first crank and said pivoted linkage and said second crank and said at least one pivoted linkage being such that as said handle moves said platten to said printing position the cranks and linkage move towards an aligned position so that the mechanical advantage increases.

6. A machine according to claim 5 in which said printing platten is arranged to reach the limit of its rearward movement slightly in advance of the instant the printing die contacts the item to be printed.

7. A machine according to claim 1 wherein the take-up mechanism comprises a pair of nip rolls for drawing a length of foil over the printing platten, said rack having teeth engaging said gear driving said nip rolls, said rack teeth and gear being shaped so as to engage and drive in one direction only, whereby said handle operates said nip rolls as said handle moves said platten away from said printing position.

8. A machine according to claim 1 wherein the take-up mechanism comprises a pair of nip rolls, the gear being fixed to one of said nip rolls.

9. A machine according to claim 1 or claim 8 wherein said one direction of movement of the rack corresponds to movement of said handle to move the platten from its rearward printing position to its forward loading position.

10. A hot printing machine comprising:

a printing platten for supporting an item to be printed, means for reciprocatably mounting said platten between a forward loading and unloading position and a rearward printing position, a downwardly movable printing head with a plate mounted thereto for pivotal movement between a downward facing printing orientation and an upward facing setting orientation, said plate capable of carrying a printing die, a prop mounted on the platten for pivotal movement to and from a support position at which it is coupled to said plate to hold said plate in its setting orientation, heating means included in said head for heating said plate in its printing orientation and a die carried by said head, link means for linking the downward movement of said printing head with rearward movement of said platten so that, before contact of said die with said item to be printed, said platten has been moved to its rearward printing position, and means for supporting a length of printing foil beneath said heated die so that when said die is pressed by said head against said item to be printed, the foil is sandwiched therebetween to give the printing effect required.

11. A hot printing machine comprising:

a printing platten for supporting an item to be printed, means for mounting said platten for reciprocal movement along a substantially horizontal first axis between a forward loading and unloading position and a rearward printing position, a printing head reciprocally movable along a substantially vertical second axis, and with a plate mounted thereto for pivotal movement between a downward facing printing orientation and an upward facing setting orientation, said plate capable of carrying a printing die, a prop mounted on the platten for pivotal movement to and from a support position at which it is coupled to said plate to hold said plate in its setting orientation, heating means included in said head for heating said plate in its printing orientation and a die carried by said head, a handle mounted on the machine for pivotal movement about an axis substantially perpendicular to the plane containing said first and second axes, link means for linking movement of said handle with movement of said printing head and with movement of said platten so that, before contact of said die with said item to be printed, said platten has been moved to its rearward printing position, means for supporting a supply roll of printing foil forwardly of said second axis, and means for guiding said foil along a path substantially in the plane containing the first and second axes which passes beneath said heated die to a take-up mechanism so that when said die is pressed by said head against said item to be printed, the foil is sandwiched therebetween to give the printing effect required, and a gear coupled to the take-up mechanism, and a rack urged against the gear, the rack and gear forming a ratchet by which the rack rotates the gear to draw a length of said foil along said path during movement thereof in one direction, and slides over the gear during movement thereof in the other direction, such reciprocal movement being coupled to the handle such that a length of foil is drawn along said path as the handle is pivoted in one direction but not in the other.

* * * * *